United States Patent [19]

Marshall

[11] 4,082,508

[45] Apr. 4, 1978

[54] TREATMENT OF TEXTILE MATERIALS

[75] Inventor: Clifford Marshall, Runcorn, England

[73] Assignee: Imperial Chemical Industries Limited, London, England

[21] Appl. No.: 331,710

[22] Filed: Feb. 12, 1973

Related U.S. Application Data

[62] Division of Ser. No. 831,769, Jun. 9, 1969, abandoned.

[30] Foreign Application Priority Data

| | | |
|---|---|---|
| Jun. 25, 1968 | United Kingdom | 30216/68 |
| Apr. 16, 1969 | United Kingdom | 19457/69 |

[51] Int. Cl.[2] ..... D06B 1/08

[52] U.S. Cl. ..... 8/139.1; 8/137; 8/142

[58] Field of Search ..... 8/137, 139.1

[56] References Cited

U.S. PATENT DOCUMENTS

| | | | |
|---|---|---|---|
| 698,209 | 4/1902 | Maertsens | 8/139.1 |
| 1,478,203 | 12/1923 | Coghlan | 8/139.1 |
| 2,828,180 | 3/1958 | Sertouo | 8/62 |
| 3,523,749 | 8/1970 | MacLeod et al. | 8/54.2 |
| 3,630,661 | 12/1971 | Ramier | 8/139.1 |

OTHER PUBLICATIONS

Hofstetter *Melliand Textilberictile*, 3, 1969 pp. 321–334 (Translator 29 pages).

White, American Dyestuff Reporter, July 31, 1967 pp. 18–24.

*Primary Examiner*—Donald Levy

*Attorney, Agent, or Firm*—Cushman, Darby & Cushman

[57] ABSTRACT

Applicant dewaxes a fabric by applying a surfactant in a hydrocarbon or halohydrocarbon solvent to the fabric without removing the wax. He removes the solvent and then washes the fabric with the surfactant and wax thereon in an aqueous medium.

11 Claims, No Drawings

TREATMENT OF TEXTILE MATERIALS

This is a division of application Ser. No. 831,769 filed June 9, 1969, now abandoned.

This invention relates to the treatment of textile materials and particularly to a process for the treatment of textile materials involving the application of treatment agents to the textile materials.

It is well known to apply substances to textile fibres, especially but not exclusively fibres of animal or vegetable origin, to assist in the operations, especially weaving, to which the fibres are subjected during formation into fabrics. The substances applied are commonly called sizing agents and they have the twofold effect of lubrication and of increasing the strength of the fibres to help them to withstand the stresses applied during the weaving operation. After weaving it is usually necessary to remove the sizing agents since these interfere in subsequent processing operations, for example scouring, bleaching and dyeing, to which the textile material is subjected.

It is also well known to apply other treatment agents to textile materials to enhance their appearance or modify (improve) their physical properties. Thus, for example, it is common practice to apply dyestuffs and pigments, wetting agents, fluorescent ("optical") brightening agents and agents, e.g. oxidising agents, for removing sizes. These treatment agents may be permanent, i.e. they are not subsequently removed from the textile material, or they may be temporary. For example dyestuffs are usually permanent whilst de-sizing agents are temporary.

Among the wide range of substances commonly applied to textile materials there are various coating compositions and other resins and polymeric substances which are known in the art as "textile finishing agents". It is to be understood that the present invention is not concerned with these "finishing agents" which are not included within the term "treatment agent" as used throughout this specification.

Among the least expensive and most commonly used sizing agents for fibres of animal or vegetable origin, especially cotton fibres, are the starches, and it is a well-established practice to remove these after the weaving operation by treatment with enzymes. The enzymes used are amylases and these have the effect of degrading the starch molecules to yield degradation products which can be removed from textile fibres simply by washing with mild alkaline solutions or with water. Other sizing agents than starch are, however, used and these may be degradable by enzymes. For example gelatin is a fairly common sizing agent and this can be removed by means of proteolytic enzymes such as gelatase. Moreover, enzymes are usually mixtures of amylases and proteolytic enzymes unless special care is taken to obtain one type in a pure form.

Hitherto treatment agents have been applied to textile materials from aqueous solutions or suspensions of the agent. One of the disadvantages encountered in this known process is that some textile materials, especially when sized, e.g. "grey cloth", are wetted by water only with difficulty. Uniform and thorough wetting is required in order to achieve a rapid and satisfactory process and it is often necessary to include a surfactant in the aqueous solution or suspension to facilitate wetting of the fabric, thus increasing the cost of the process. Furthermore, it is necessary before or after an aqueous desizing process to scour the fabrics to remove the wax content (fats, oils and waxes) prior to bleaching or other treatments, since the aqueous desizing system has little, if any, effect upon the wax content of the treated material.

We have now devised a process for treating textile materials with treatment agents whereby the above disadvantages are obviated. For example, we have now devised a process for desizing textile materials using enzymes whereby the material is easily wetted and whereby after the treatment some types of fabric may be bleached directly (i.e. without first requiring to be scoured), for example by a peroxide bleach treatment. The process may provide for simultaneous desizing and partial scouring of the textile material.

According to the present invention we provide a process for the treatment of textile materials which comprises applying to the textile material a solution or suspension of one or more treatment agents in a hydrocarbon or halogenated hydrocarbon solvent and subsequently removing the solvent from the textile material. The treated textile material normally will be washed after removal of the solvent.

Textile materials made of either natural or synthetic fibres are in general readily wetted by hydrocarbon and halogenated hydrocarbon solvents and consequently application of the treatment agent is a rapid and simple matter. For example the solution or suspension of the agent can be applied by immersion of the fabric therein, or by spraying, padding or licking. The temperature of the solution or suspension during application to the textile material may be up to the boiling point of the solvent. Room temperatures may be conveniently employed so that solvent losses during application to the textile material are minimised.

Impregnation of the textile material with the solution or suspension of the treatment agent will usually be under conditions such that the wax content (fats, oils, waxes and other dirt) of the fibres remains in the impregnated material and does not produce serious contamination of the impregnating bath. If the solution or suspension is applied by immersing the textile material therein, the immersion time is advantageously very low.

After impregnating the textile material with the solution or suspension of the treatment agent the hydrocarbon or halogenated hydrocarbon solvent is removed. This leaves the treatment agent evenly distributed throughout the textile material. Any method of removing the solvent can be used, for example air drying, especially using hot air, but we prefer that the removal be rapid, for example by causing rapid vaporisation of the solvent. The resulting solvent vapours may be condensed to recover the solvent for re-use. We especially prefer to pass the impregnated material directly into steam in known manner to flash-off the solvent. Advantageously the steam is caused to flow counter to the direction of movement of the textile material. Hot water may be used instead of steam but there is then a risk that treatment agent will be extracted from the material into the water of the flash-off bath.

If it is desired to incorporate the process in a conventional solvent scouring process then the solution or suspension of the treatment agent can be applied to the textile material as it leaves the solvent scouring vessel, i.e. after the dewaxing is completed and the excess solvent has been removed, for example by expression of the textile material, but before the flash-off vessel.

We believe that the presence of some water in the material after removal of the solvent is in some cases desirable and helps to promote the desired action of the treatment agent; for example water may be required to promote the action of enzymes. The natural moisture regain of certain types of fibres may be sufficient for this purpose. Moreover, the textile material will usually (but not necessarily) be withdrawn from the vessel in which the solvent is removed from it through a water seal so that a wet material is obtained.

The time for which the textile material is maintained in contact with steam should preferably be sufficient to remove substantially the whole of the solvent from the material so that the solvent can be recovered for re-use. In general times of 10 to 60 seconds are sufficient for this purpose. After steaming, the textile material can be immediately washed, for example with an alkaline aqueous solution.

It is well known that amylase enzymes lose their activity at an increasing rate if subjected to temperatures above 70° C. Thus contacting the solvent-laden material with steam deactivates the amylases, but the deactivation is not instantaneous and sufficient degradation of the starch takes place before amylases are deactivated. The treatment agent may be soluble or insoluble in the halogenated hydrocarbon solvent. Alternatively the agent may be employed as a solution or suspension in a solvent, for example water, which may be of itself suspended in the hydrocarbon or halogenated hydrocarbon solvent, for example as an emulsion. Such systems are for the purposes of this specification to be regarded as a suspension of the treatment agent in the solvent; thus, an emulsion of an aqueous solution of a treatment agent in a hydrocarbon or halogenated hydrocarbon solvent is a suspension within that term as used in this specification.

Examples of treatment agents which may be applied by the process are surface active agents (ionic or non-ionic), dyestuffs and pigments, fluorescent brightening agents which are commonly termed "optical" brightening agents, enzyme desizing agents, and oxidative agents employed for desizing for example sodium bromite and ammonium persulphate. As stated hereinbefore, removal of the solvent from the textile material leaves the treatment agent evenly distributed throughout the material. We have found that in the case where the treatment agent is a surface active agent (commonly known as a "wetting" agent), washing the textile material subsequent to removing the solvent from it results in removal from the textile material of at least a proportion of the initial wax content (grease, fats, oils and waxes) of the textile fibres.

We have found it to be an advantage that brightening agents or dyestuffs used in the process should be fairly pure since impurities therein tend to render unstable suspensions of the agent in the hydrocarbon or halogenated hydrocarbon solvent.

We have found, surprisingly, that amylases are not deactivated by halogenated hydrocarbons whereas they are deactivated by a large number of metallic salts, e.g. mercuric chloride and copper sulphate, picric acid and formaldehyde, and by polar solvents, for example ketones and especially alcohols which deactivate amylases almost instantaneously. We have found, on the other hand, that a suspension of amylases or aqueous solutions of amylases in trichloroethylene do not noticeably decrease in activity even after prolonged storage.

The concentration of the treatment agent in the solution or suspension can be the same as is usual in the aqueous solutions used in the corresponding well-established aqueous processes and will depend upon the particular treatment agent employed. These concentrations are well known in the art, and in any event can be determined by simple experiment. When an enzyme preparation is being applied to the textile material the pH of the suspension during application to the textile material is important since as is well known amylases tend to be deactivated at a pH of below 4.0 or greater than 8.0. In general, for maximum efficiency, the pH of the suspension is maintained in the range 6 to 7. Enzymes as generally available are usually admixed with inorganic salts and we have found that it is preferable to remove these salts prior to use of the enzymes, for example by sieving e.g. using a 240 mesh B.S.S. sieve. Amylase enzymes as generally available also contain small amounts of proteinase enzymes and these may be advantageously retained for the purpose of removing any protein matter from the sized textile materials.

In conventional treatments of synthetic textile materials or materials containing synthetic fibres with some types of treatment agents, particularly fluorescent brightening agents and some dyestuffs, it is usual to bake the textile material subsequent to application of the treatment agent to heat-set the fabric and/or to set the agent so that it is not removed during any washing to which the material is later subjected. A baking step may be included in the process of the present invention, in which case removal of the solvent from the textile material may occur during the heating of the textile material. Baking temperatures of from 150° C to 210° C will usually be employed with times of 30 seconds to 10 seconds respectively.

Formation of a suspension of an insoluble treatment agent, for example an enzyme preparation, in the hydrocarbon or halogenated hydrocarbon solvent may be facilitated by use of one or more suspending or dispersing agents (emulsifying agents) which are chemically inert to the treatment agent and to the solvent. These will be removed from the textile material during subsequent washing processes and, as hereinbefore described, may have the advantage of assisting removal of impurities from the textile material during the washing operation. Thus the agent will assist the removal of products of degradation of sizing agents by enzymes.

Any hydrocarbon or halogenated hydrocarbon solvent can be used to form the solution or suspension of the treatment agent although we prefer to use a chlorinated or chlorofluorinated aliphatic hydrocarbon solvent. Examples of suitable solvents are trichloroethylene, perchloroethylene, 1,1,2-trichloro-1,2,2-trifluoroethane and 1,1,1-trichloroethane. Mixtures of solvents may be used if desired.

The textile material may be made of any natural or man-made fibres, although the process is particularly suited to the treatment of textile materials made of vegetable fibres, especially cotton fibres and blends including cotton fibres. The material may be loomstate (grey) cloth or it may be in a wide variety of forms, for example loose fibres, laps or felts, yarns and knitted or woven fabrics.

The process for desizing textiles using an enzyme preparation is useful in the treatment of any textile fibres to which an enzyme-degradable sizing agent has been applied. Usually such sizing agents, for example starch or gelatin, are used on fibres of vegetable origin, especially cotton, although they might be used on animal fibres or even on man-made fibres. Although synthetic fibres are not usually sized they are not harmed by the present process and consequently blends of natural fibres and synthetic fibres can be treated by the process, for example blends of cotton with polyester or with rayon.

The invention is illustrated but in no way limited by the following Examples in which all percentages are by weight.

EXAMPLE 1

A woven loomstate textile fabric (6% polyester, 33% cotton), was impregnated by spraying with a 1% solution of isopropylamine dodecyl benzene sulfphonate (a wetting agent available under the trade name Nansa YS 94) in trichloroethylene. The impregnated fabric, which contained its own weight of the solution, was contacted in open width with steam for 15 seconds during which time substantially all of the trichloroethylene was removed. After the steam treatment the fabric was washed for 1 minute in a dilute alkaline wash liquor.

The solvent-soluble matter (wax, fats, grease, etc.) remaining in the fabric was then determined by Soxhlet extraction and was found to be 0.41% compared with 1.83% in the untreated fabric.

The above procedure was repeated using different woven fabrics and the results are summarised in the table below:

Table

| Fabric | Initial wax (%) | Final wax (%) |
|---|---|---|
| 67% polyester/33% cotton | 1.83 | 0.41 |
| 100% cotton | 0.97 | 0.38 |
| 100% polyester | 0.73 | 0.28 |
| 100% wool | 2.73 | 0.11 |

EXAMPLE 2

A sample of the polyester/cotton fabric treated in Example 1 and of solvent-soluble content 0.41% was subjected to a conventional pad-roll bleach using aqueous hydrogen peroxide. The sample was then washed and its wax content determined. The solvent-soluble content had been reduced to 0.17%.

EXAMPLE 3

A polyester/cotton fabric as in Example 1 was treated by the procedure of Example 1 except that instead of the treatment with steam for 10 seconds there was employed a treatment with hot air at 100° C for 3 minutes. The content of solvent-soluble material in the treated fabric was 0.43%.

EXAMPLE 4

A 100% wool fabric was treated with a solution of the wetting agent in trichloroethylene described in Example 1. The impregnated fabric was then passed in open width through a bath of hot water at 95° to 100° C, the immersion time being 30 seconds. The content of solvent-soluble material was found to be 0.38% compared with 2.73% in the untreated fabric.

EXAMPLE 5

A sample of 100% cotton fabric made from starch-sized cotton fibres and having an initial starch equivalent of 8.37% and a wax content (B.S. 3477 - 1962) of 0.91% was padded to approximately 100% expression with a suspension in trichloroethylene of an enzyme preparation available under the trade name Nervanase 10X (20 gm/l).

Immediately after padding, the sample was steamed at 100° C for 20 seconds and was then washed by immersion in an aqueous solution of caustic soda (3 gm/l) at 90° C for 1 minute. The sample was then subjected to a second wash in water at 80° C for 1 minute and finally to a cold rinse in water. The starch equivalent and wax content of the sample was then determined and the results are shown in Table 1 below.

The above procedure was then repeated 4 times (experiments Nos. 2–5) but using different concentrations of the enzyme suspension as shown in Table 1 below.

For purposes of comparison, experiments 1–5 were repeated (experiments Nos. 6–10) except that a solution of the enzyme preparation in water containing Lissapol ND as wetting agent was used instead of the suspension in trichloroethylene. The results are again shown in Table 1 below.

In a further experiment (No. 11) again for purposes of comparison, a sample of the fabric was immersed for 1 hour in an aqueous solution of the enzyme preparation (1 gm/l) at 70° C with a liquor/goods ratio of 25:1. The sample was then washed and rinsed as in experiment No. 1 and its starch equivalent was determined and is shown in Table 1 below.

A further experiment (No. 12 ) was performed to demonstrate the effect of the enzymes in the process of the invention. A sample of the fabric was padded to approximately 100% expression with pure trichloroethylene, and the impregnated fabric was then steamed and washed as described in experiment No. 1. The starch equivalent of the treated fabric was determined and is shown in Table 1 below:

Table 1

| Experiment No. | Enzyme Concentration (gm/l) | Starch Equivalent (%)* | Wax Content % |
|---|---|---|---|
| 1 | 20 | 1.61 | 0.49 |
| 2 | 10 | 1.64 | 0.49 |
| 3 | 5 | 1.99 | 0.49 |
| 4 | 2 | 2.12 | 0.48 |
| 5 | 1 | 2.50 | 0.48 |
| Untreated Fabric | | 8.37 | 0.91 |
| 6 | 20 | 1.46 | 0.78 |
| 7 | 10 | 1.67 | 0.79 |
| 8 | 5 | 1.76 | 0.80 |
| 9 | 2 | 2.14 | 0.79 |
| 10 | 1 | 2.24 | 0.76 |
| 11 | 1 | 1.28 | — |
| 12 | None | 4.70 | — |

*The starch equivalent figures quoted make no allowance for the natural starch equivalent of the textile material, i.e. to the starch equivalent not due to applying a size to the textile material. Thus a complete desize of the textile material would not result in a starch equivalent figure of zero. In fact, the long liquor process of experiment No. 11 results in almost complete removal of sizing agents showing that the natural starch equivalent of the textile material was in the region of 1.25%.

What we claim is:

1. A process for dewaxing textile material having a wax content of the fibers, the steps of which consist essentially of impregnating the textile material with a solution of a surfactant in a hydrocarbon or halogenated hydrocarbon solvent so that wax content of the fibres remains in the textile material, removing the solvent from the textile and leaving the surfactant evenly distributed throughout the textile material and then washing the surfactant-containing textile material in an aqueous medium.

2. A process as claimed in claim 1 wherein the solvent is vaporised to remove it from the textile material.

3. A process as claimed in claim 2 wherein the solvent is vaporised by contacting the textile material with steam.

4. A process as claimed in claim 3 wherein the textile material is treated with steam moving in a direction counter to the direction of movement of the textile material.

5. A process as claimed in claim 2 wherein the solvent is vaporised by contacting the textile material with hot water.

6. A process as claimed in claim 1 wherein the textile material is washed in an alkaline aqueous solution.

7. A process as claimed in claim 1 wherein there is employed a suspension of the solution of the surfactant in the hydrocarbon or halogenated hydrocarbon solvent.

8. A process as claimed in claim 1 wherein the solvent is a halogenated aliphatic hydrocarbon solvent.

9. A process as claimed in claim 8 wherein the solvent is a chlorinated aliphatic hydrocarbon solvent.

10. A process as claimed in claim 9 wherein the solvent is trichloroethylene.

11. A process as claimed in claim 1 wherein the textile material is a loomstate material.

* * * * *